US012559812B2

(12) United States Patent
Uhrin et al.

(10) Patent No.: US 12,559,812 B2
(45) Date of Patent: Feb. 24, 2026

(54) METHOD OF MAKING A TEE RAIL HAVING A HIGH STRENGTH BASE

(71) Applicant: ArcelorMittal, Luxembourg (LU)

(72) Inventors: Raymond Uhrin, Hummelstown, PA (US); Zachary Royer, Mechanicsburg, PA (US); Jason Mccullough, Camp Hill, PA (US); Richard L Perry, Allentown, PA (US); Bruce Stevenson, Fleetwood, PA (US)

(73) Assignee: ArcelorMittal, Luxembourg (LU)

( * ) Notice: Subject to any disclaimer, the term of this patent is extended or adjusted under 35 U.S.C. 154(b) by 858 days.

(21) Appl. No.: 17/414,220

(22) PCT Filed: Dec. 20, 2018

(86) PCT No.: PCT/IB2018/060411
§ 371 (c)(1),
(2) Date: Jun. 15, 2021

(87) PCT Pub. No.: WO2020/128589
PCT Pub. Date: Jun. 25, 2020

(65) Prior Publication Data

US 2022/0042128 A1 Feb. 10, 2022

(51) Int. Cl.
*C21D 9/04* (2006.01)
*C21D 1/667* (2006.01)
(Continued)

(52) U.S. Cl.
CPC ..... *C21D 9/04* (2013.01); *C21D 1/667* (2013.01); *C21D 6/004* (2013.01); *C21D 6/005* (2013.01);
(Continued)

(58) Field of Classification Search
CPC ..... C21D 1/667; C21D 9/04
See application file for complete search history.

(56) References Cited

U.S. PATENT DOCUMENTS 3,193,270 A * 7/1965 Dewez, Jr. ..... C21D 9/06 72/701
5,658,400 A 8/1997 Uchino et al.
(Continued)

FOREIGN PATENT DOCUMENTS

CN 1140473 A 1/1997
CN 1793403 A 6/2006
(Continued)

OTHER PUBLICATIONS

Hammer Steel. "Tee rails". 2010. Retrieved from: https://www.harmersteel.com/catalog/tee-rails/ (Year: 2010).*
See Search Report of PCT/IB2018/060411 dated Nov. 7, 2019.

*Primary Examiner* — Nicholas A Wang
(74) *Attorney, Agent, or Firm* — Davidson Kappel LLC

(57) ABSTRACT

A method of making a high strength base-hardened tee rail and the tee rail produced by the method. The method includes the steps of providing a carbon steel tee rail, the steel tee rail provided at a temperature between 70° and 800° C.; and cooling the steel tee rail at a cooling rate that the temperature in ° C. of the surface of the base of said steel tee rail, is maintained in a region between: an upper cooling rate boundary plot defined by an upper line connecting xy-coordinates (0 s, 800° C.), (80 s, 675° C.), (110 s, 650° C.) and (140 s, 635° C.); and a lower cooling rate boundary plot defined by a lower line connecting xy-coordinates (0 s, 700° C.), (80 s, 575° C.), (110 s, 550° C.) and (140 s, 535° C.).

1 Claim, 4 Drawing Sheets

(51) Int. Cl.

| | |
|---|---|
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |

(52) U.S. Cl.
CPC ..... *C21D 6/008* (2013.01); *C21D 8/005* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C21D 2211/009* (2013.01)

(56) References Cited

U.S. PATENT DOCUMENTS

| | | | | |
|---|---|---|---|---|
| 5,762,723 | A | 6/1998 | Ueda et al. | |
| 9,476,107 | B2 | 10/2016 | Bramfitt et al. | |
| 2014/0130943 | A1* | 5/2014 | Bramfitt ..... | C21D 9/04 148/581 |
| 2014/0182751 | A1 | 7/2014 | Zou et al. | |
| 2017/0369961 | A1 | 12/2017 | Ueda et al. | |
| 2018/0112284 | A1 | 4/2018 | Bramfitt et al. | |

FOREIGN PATENT DOCUMENTS

| | | | | |
|---|---|---|---|---|
| CN | 102859010 | A | | 1/2013 |
| CN | 107208216 | A | | 9/2017 |
| JP | H 01139724 | A | | 6/1989 |
| JP | 2003129180 | | * | 5/2003 |
| JP | 2006057127 | | * | 3/2006 |
| JP | 2006057127 | A | | 3/2006 |
| JP | 2016053191 | | * | 4/2016 |

* cited by examiner

METHOD OF MAKING A TEE RAIL HAVING A HIGH STRENGTH BASE

FIELD OF THE INVENTION

The present invention relates to steel rails and more particularly to tee rails. Specifically, the present invention relates to a tee rail having a high strength base and a method of production thereof.

BACKGROUND OF THE INVENTION

Head hardened tee rails have been developed and utilized in both freight and passenger service applications in the United States and throughout the world. These rails have provided improved mechanical properties such as higher yield strength and tensile strength. This has given these tee rail heads improved fatigue resistance, wear resistance and ultimately provided them with a longer service life.

As loads have increased and rail fasteners have become more rigid, the rail base has become a concern. The base must now withstand higher plastic deformation and the accompanying fatigue damage. Presently there is no industry wide standard specification for steel rails with increased base strength/hardness. Rails with "as rolled" bases are being used in all applications. Thus, there is a true need in the art for a tee rails with bases having a higher strength/hardness than is presently conventionally available.

SUMMARY OF THE INVENTION

The present invention relates to a method of making tee rails having bases with high strength/hardness and the tee rails produced by the method. The method may comprise the steps of: providing a carbon steel tee rail at a temperature between about 700 and 800° C.; and cooling the steel tee rail at a cooling rate that, if plotted on a graph with xy-coordinates with the x-axis representing cooling time in seconds and the y-axis representing temperature in ° C. of the surface of the base of the steel tee rail, is maintained in a region between:

- an upper cooling rate boundary plot defined by an upper line connecting xy-coordinates (0 s, 800° C.), (80 s, 675° C.), (110 s, 650° C.) and (140 s, 635° C.); and
- a lower cooling rate boundary plot defined by a lower line connecting xy-coordinates (0 s, 700° C.), (80 s, 575° C.), (110 s, 550° C.) and (140 s, 535° C.).

The carbon steel tee rail may have a AREMA standard chemistry composition that comprises, in weight percent: Carbon: 0.74-0.86; Manganese: 0.75-1.25; Silicon: 0.10-0.60; Chromium: 0.30 Max; Vanadium: 0.01 Max; Nickel: 0.25 Max; Molybdenum: 0.60 Max; Aluminum: 0.010 Max; Sulphur: 0.020 Max; Phosphorus: 0.020 Max; and the remainder being predominantly iron.

The carbon steel tee rail may alternatively have a composition that comprises, in weight percent: Carbon: 0.84-1.00; Manganese: 0.40-1.25; Silicon: 0.30-1.00; Chromium: 0.20-1.00; Vanadium: 0.04-0.35; Titanium: 0.01-0.035; Nitrogen: 0.002-0.0150; and the remainder being iron and residuals.

The carbon steel tee rail may further have a composition that comprises, in weight percent: Carbon: 0.86-0.9; Manganese: 0.65-1.0; Silicon: 0.5-0.6; Chromium: 0.2-0.3; Vanadium: 0.04-0.15; Titanium: 0.015-0.03; Nitrogen: 0.005-0.015; and the remainder being iron and residuals.

The tee rail may have a base portion that has a fully pearlitic microstructure. And the tee rail may have an average Brinell hardness of at least 350 HB at a depth of 9.5 mm from the bottom face of the tee rail base.

The cooling rate from 0 second to 80 seconds may have an average within a range of between about 1.25° C./sec and 2.5° C./sec. Further, the cooling rate from 80 seconds to 110 seconds may have an average within a range of between about 1° C./sec and 1.5° C./sec. Finally, the cooling rate from110 seconds to 140 seconds may have an average within a range of between about 0.1° C./sec and 0.5° C./sec.

The step of providing a carbon steel tee rail may further comprise the steps of:

forming a steel melt at a temperature of about 1600° C. to about 1650° C. by sequentially adding manganese, silicon, carbon, chromium, followed by titanium and vanadium in any order or in combination to form the melt; vacuum degassing the melt to further remove oxygen, hydrogen and other potentially harmful gases; casting the melt into blooms; heating the cast blooms to about 1220° C.; rolling the bloom into a "rolled" bloom employing a plurality of passes on a blooming mill; placing the rolled blooms into a reheat furnace; re-heating the rolled blooms to about 1220° C. to provide a uniform rail rolling temperature; descaling the rolled bloom; passing the rolled bloom sequentially through a roughing mill, intermediate roughing mill and a finishing mill to create a finished steel rail, the finishing mill having an output finishing temperature of 1040° C.; descaling the finished steel rail above about 900° C. to obtain a uniform secondary oxide thereon; and air cooling the finished rail to about 700° C.-800° C.

The step of cooling the steel rail may comprise cooling the rail with water for 140 seconds. The step of cooling the steel rail with water may comprise cooling the steel rail with spray jets of water. The water comprising the spray jets of water may be maintained at a temperature of between 8-17° C. The step of cooling the steel rail with spray jets of water may comprise directing the jets of water at the top of the rail head, the sides of the rail head, and the base of the rail. The step of cooling the steel rail with spray jets of water may comprise passing the steel rail through a cooling chamber which includes the spray jets of water.

The cooling chamber may comprise two sections and the water flow rate in each section may be varied depending on the cooling requirement in each of the sections. The greatest amount of water may be applied in the first/inlet section of the cooling chamber, creating a cooling rate fast enough to suppress the formation of proeutectoid cementite and initiate the start of the pearlite transformation below 700° C. The water flow rate in the first/inlet section of the cooling chamber may be between 15-40 $m^3$/hr, and the water flow rate in the second/last section of the cooling chamber may be between 5-30 $m^3$/hr. The step of cooling the steel rail may further comprise the step of cooling the rail in air to ambient temperature after the step of cooling the rail with water for 140 seconds.

DETAILED DESCRIPTION OF THE INVENTION

Figure 1:
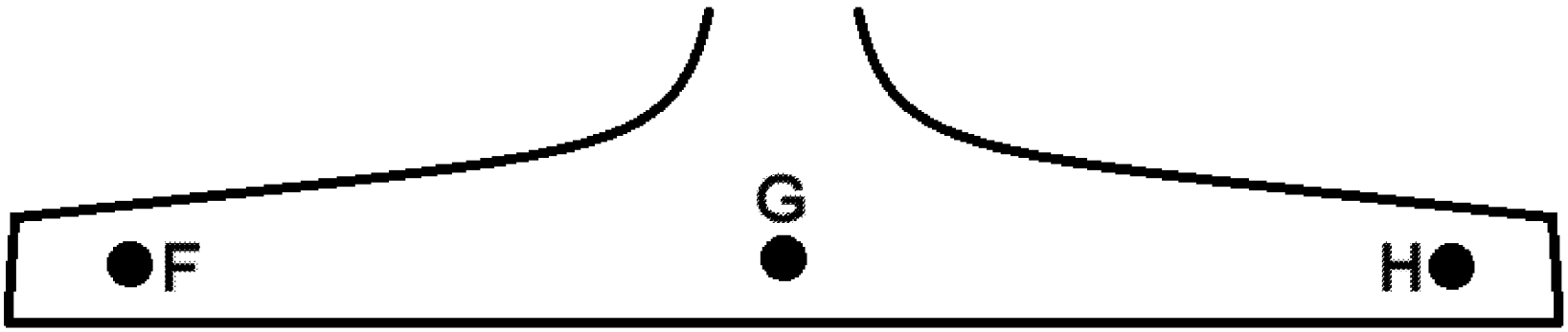
FIG. 1 is a schematic depiction of the base section of a tee rail and specifically shows the positions on the tee rail base where the hardness thereof is measured.

The present invention involves a combination of steel composition and accelerated base cooling to produce tee rails with high strength/hardness bases.

Compositions of Rails Useful with the Inventive Process

AREMA Steel Rails

A steel composition for tee rails which are useful in the inventive process is the AREMA standard chemistry steel rail. This AREMA standard composition comprises (in wt. %):

Carbon: 0.74-0.86;
Manganese: 0.75-1.25;
Silicon: 0.10-0.60;
Chromium: 0.30 Max
Vanadium: 0.01 Max
Nickel: 0.25 Max
Molybdenum: 0.60 Max
Aluminum: 0.010 Max
Sulphur: 0.020 Max
Phosphorus: 0.020 Max
and the remainder being iron and residuals Alternative Composition A second composition from which the tee rails of the present invention may be formed is the following composition in weight %, with iron being the substantial remainder:

Carbon 0.84-1.00 (preferably 0.86-0.9)
Manganese 0.40-1.25 (preferably 0.65-1.0)
Silicon 0.30-1.00 (preferably 0.5-0.6)
Chromium 0.20-1.00 (preferably 0.2-0.3)
Vanadium 0.04-0.35 (preferably 0.04-0.15)
Titanium 0.01-0.035 (preferably 0.015-0.03)
Nitrogen 0.002-0.0150 (preferably 0.005-0.015)
and the remainder being iron and residuals.

Carbon is essential to achieve high strength rail properties. Carbon combines with iron to form iron carbide (cementite). The iron carbide contributes to high hardness and imparts high strength to rail steel. With high carbon content (above about 0.8 wt % C, optionally above 0.9 wt %) a higher volume fraction of iron carbide (cementite) continues to form above that of conventional eutectoid (pearlitic) steel. One way to utilize the higher carbon content in the new steel is by accelerated cooling (base hardening) and suppressing the formation of harmful proeutectoid cementite networks on austenite grain boundaries. As discussed below, the higher carbon level also avoids the formation of soft ferrite at the rail surface by normal decarburization. In other words, the steel has sufficient carbon to prevent the surface of the steel from becoming hypoeutectoid. Carbon levels greater than 1 wt % can create undesirable cementite networks.

Manganese is a deoxidizer of the liquid steel and is added to tie-up sulfur in the form of manganese sulfides, thus preventing the formation of iron sulfides that are brittle and deleterious to hot ductility. Manganese also contributes to hardness and strength of the pearlite by retarding the pearlite transformation nucleation, thereby lowering the transformation temperature and decreasing interlamellar pearlite spacing. High levels of manganese can generate undesirable internal segregation during solidification and microstructures that degrade properties. In exemplary embodiments, manganese is lowered from a conventional head-hardened steel composition level to shift the "nose" of the continuous cooling transformation (CCT) diagram to shorter times i.e. the curve is shifted to the left. Generally, more pearlite and lower transformation products (e.g., bainite) form near the "nose." In accordance with exemplary embodiments, the initial cooling rate is accelerated to take advantage of this shift, the cooling rates are accelerated to form the pearlite near the nose. Operating the head-hardening process at higher cooling rates promotes a finer (and harder) pearlitic microstructure. With the inventive composition, base hardening can be conducted at higher cooling rates without the occurrence of instability. Therefore, manganese is kept below 1% to decrease segregation and prevent undesired microstructures. The manganese level is preferably maintained above about 0.40 wt % to tie up the sulfur through the formation of manganese sulfide. High sulfur contents can create high levels of iron sulfide and lead to increased brittleness.

Silicon is another deoxidizer of the liquid steel and is a powerful solid solution strengthener of the ferrite phase in the pearlite (silicon does not combine with cementite). Silicon also suppresses the formation of continuous proeutectoid cementite networks on the prior austenite grain boundaries by altering the activity of carbon in the austenite. Silicon is preferably present at a level of at least about 0.3 wt % to prevent cementite network formation, and at a level not greater than 1.0 wt % to avoid embrittlement during hot rolling.

Chromium provides solid solution strengthening in both the ferrite and cementite phases of pearlite.

Vanadium combines with excess carbon and nitrogen to form vanadium carbide (carbonitride) during transformation for improving hardness and strengthening the ferrite phase in pearlite. The vanadium effectively competes with the iron for carbon, thereby preventing the formation of continuous cementite networks. The vanadium carbide refines the austenitic grain size, and acts to break-up the formation continuous pro-eutectoid cementite networks at austenite grain boundaries, particularly in the presence of the levels of silicon practiced by the present invention. Vanadium levels below 0.04 wt % produce insufficient vanadium carbide precipitates to suppress the continuous cementite networks. Levels above 0.35 wt % can be harmful to the elongation properties of the steel.

Titanium combines with nitrogen to form titanium nitride precipitates that pin the austenite grain boundaries during heating and rolling of the steel thereby preventing excessive austenitic grain growth. This grain refinement is important to restricting austenite grain growth during heating and rolling of the rails at finishing temperatures above 900° C. Grain refinement provides a good combination of ductility and strength. Titanium levels above 0.01 wt % are favorable to tensile elongation, producing elongation values over 8%, such as 8-12%. Titanium levels below 0.01 wt % can reduce the elongation average to below 8%. Titanium levels above 0.035 wt % can produce large TiN particles that are ineffectual for restricting austenite grain growth.

Nitrogen is important to combine with the titanium to form TiN precipitates. A naturally occurring amount of nitrogen impurity is typically present in the electric furnace melting process. It may be desirable to add additional nitrogen to the composition to bring the nitrogen level to above 0.002 wt %, which is typically a sufficient nitrogen level to allow nitrogen to combine with titanium to form titanium nitride precipitates. Generally, nitrogen levels higher than 0.0150 wt % are not necessary.

The second composition is hypereutectoid with a higher volume fraction of cementite for added hardness. The manganese is purposely reduced to prevent lower transformation products (bainite and martensite) from forming when the tee rails are welded. The silicon level is increased to provide higher hardness and to help to suppress the formation of proeutectoid cementite networks at the prior austenite grain boundaries. The slightly higher chromium is for added higher hardness. The titanium addition combines with nitrogen to form submicroscopic titanium nitride particles that precipitate in the austenite phase. These TiN particles pin the austenite grain boundaries during the heating cycle to prevent grain growth resulting in a finer austenitic grain size. The vanadium addition combines with carbon to form submicroscopic vanadium carbide particles that precipitate during the pearlite transformation and results in a strong hardening effect. Vanadium along with the silicon addition and accelerated cooling suppresses the formation of proeutectoid cementite networks.

FIG. 1 is a schematic depiction of the base section of a tee rail. The figure shows the positions on the tee rail base where the hardness (as used herein, the term hardness means Brinell hardness) thereof is measured and reported herein. The positions F and H are near the edges of the base, while position G is at the center point of the base. The tests are performed on material that is 9.5 mm depth from the bottom surface of the base.

The average center point (G) hardness of the base of untreated, as rolled, tee rails made of AREMA standard chemistry steel is about 320.

The hardness at points F, G and H and averages for several sample steel rails which have undergone the present inventive process are shown in Table 1.

TABLE 1

| | Base Hardness | | | |
|---|---|---|---|---|
| Sample | F | G (Center) | H | Average |
| 1 | 360 | 379 | 358 | 366 |
| 2 | 363 | 375 | 363 | 367 |
| 3 | 375 | 387 | 357 | 373 |
| 4 | 361 | 381 | 362 | 368 |
| 5 | 358 | 372 | 354 | 361 |
| 6 | 364 | 375 | 365 | 368 |
| AVERAGE | 364 | 378 | 360 | 367 |

The average base hardness for the inventive rails exceeds 350 (preferably 360) for all points on the base. The average center point (G) hardness of the inventive rails exceeds 370, with some rails even exceeding 380. Thus, the average base hardness of rails of the present invention exceed the center point hardness of the prior art alloys by 40 points. Even better is a comparison of average center point hardnesses of the prior art rails versus the inventive rails, where the inventive rails are a full 50 points harder.

In the production of the raw steel rails, the steelmaking may be performed in a temperature range sufficiently high to maintain the steel in a molten state. For example, the temperature may be in a range of about 1600° C. to about 1650° C. The alloying elements may be added to molten steel in any particular order, although it is desirable to arrange the addition sequence to protect certain elements such as titanium and vanadium from oxidation. According to one exemplary embodiment, manganese is added first as ferromanganese for deoxidizing the liquid steel. Next, silicon is added in the form of ferrosilicon for further deoxidizing the liquid steel. Carbon is then added, followed by chromium. Vanadium and titanium are added in the penultimate and final steps, respectively. After the alloying elements are added, the steel may be vacuum degassed to further remove oxygen and other potentially harmful gases, such as hydrogen.

Once degassed, the liquid steel may be cast into blooms (e.g., 370 mm×600 mm) in a three-strand continuous casting machine. The casting speed may be set at, for example, under 0.46 m/s. During casting, the liquid steel is protected from oxygen (air) by shrouding that involves ceramic tubes extending from the bottom of the ladle into the tundish (a holding vessel that distributes the molten steel into the three molds below) and the bottom of the tundish into each mold. The liquid steel may be electromagnetically stirred while in the casting mold to enhance homogenization and thus minimize alloy segregation.

After casting, the cast blooms are heated to about 1220° C. and rolled into a "rolled" bloom in a plurality (e.g., 15) of passes on a blooming mill. The rolled blooms are placed "hot" into a reheat furnace and re-heated to 1220° C. to provide a uniform rail rolling temperature. After descaling, the rolled bloom may be rolled into rail in multiple (e.g., 10) passes on a roughing mill, intermediate roughing mill and a finishing mill. The finishing temperature desirably is about 1040° C. The rolled rail may be descaled again above about 900° C. to obtain uniform secondary oxide on the rail prior to base hardening. The rail may be air cooled to about 700° C.-800° C.

While it is preferred to apply the inventive cooling process to newly manufactured steel rail directly at this point, while the rails are still at about 700° C.-800° C., the rails may be cooled to ambient and reheated later to the about 700° C.-800° C. starting temperature for the inventive process.

Inventive Process:

After leaving the last stand of the rail mill, the rails (while still austenitic) are sent to the base hardening machine. Starting at a surface temperature of between 700° C. and 800° C., the rail is passed through a series of water spray nozzles configured as shown in FIG. 2, which depicts a cross section of a tee rail and the water spray jets that are used to cool the tee rail.

Figure 2:
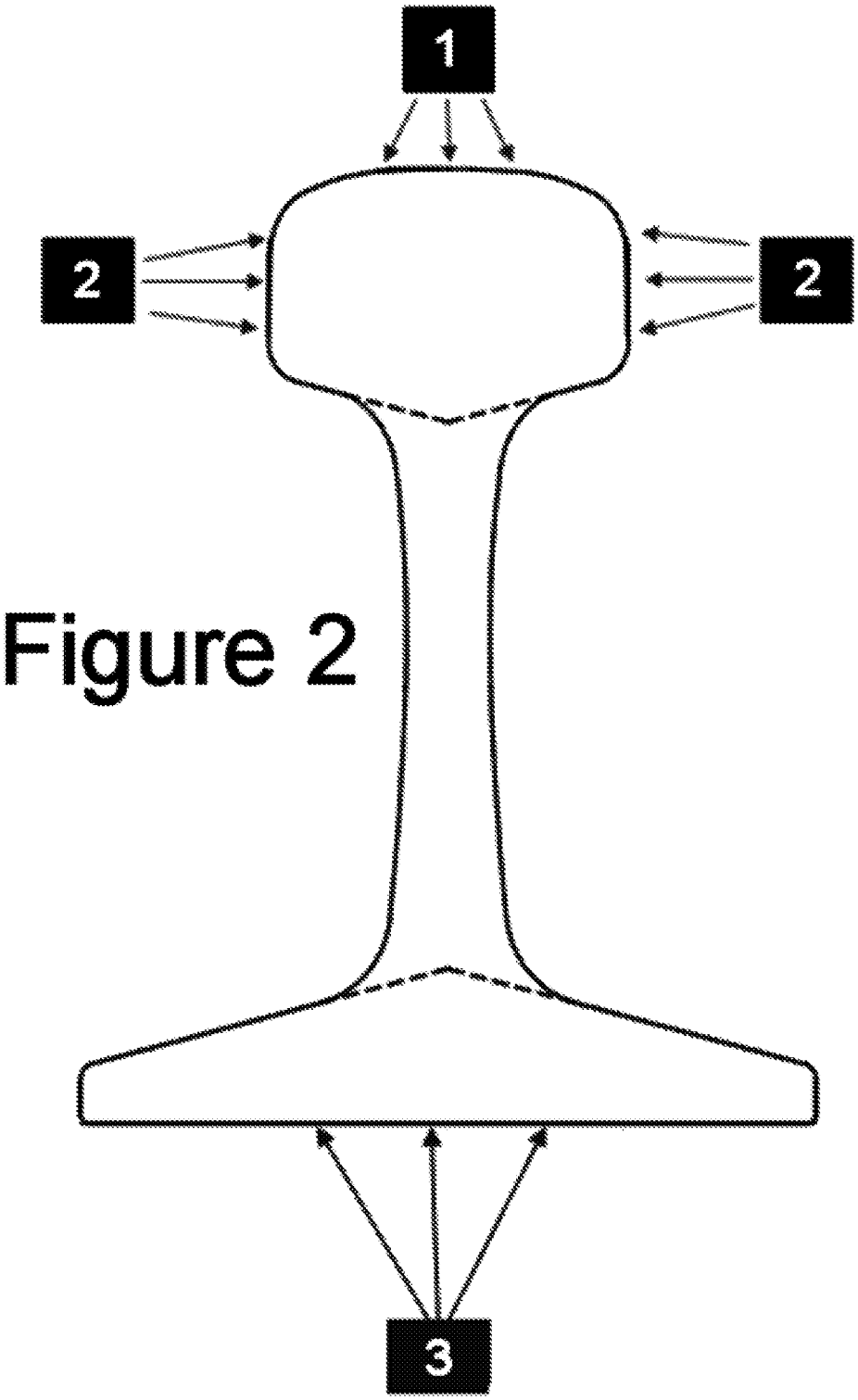
FIG. 2 depicts a cross section of a tee rail and the water spray jets that are used to cool the tee rail.

From FIG. 2, it may be seen that the water spray nozzle configuration includes a top head water spray 1, two side head water sprays 2, and a foot water spray 3. The spray nozzles are distributed longitudinally in a cooling chamber that is 100 meters long and the chamber contains hundreds of cooling nozzles. The rail moves through the spray chamber at a speed of 0.5-1.0 meters/second. For property consistency, the water temperature is controlled within 8-17° C.

Figure 3:
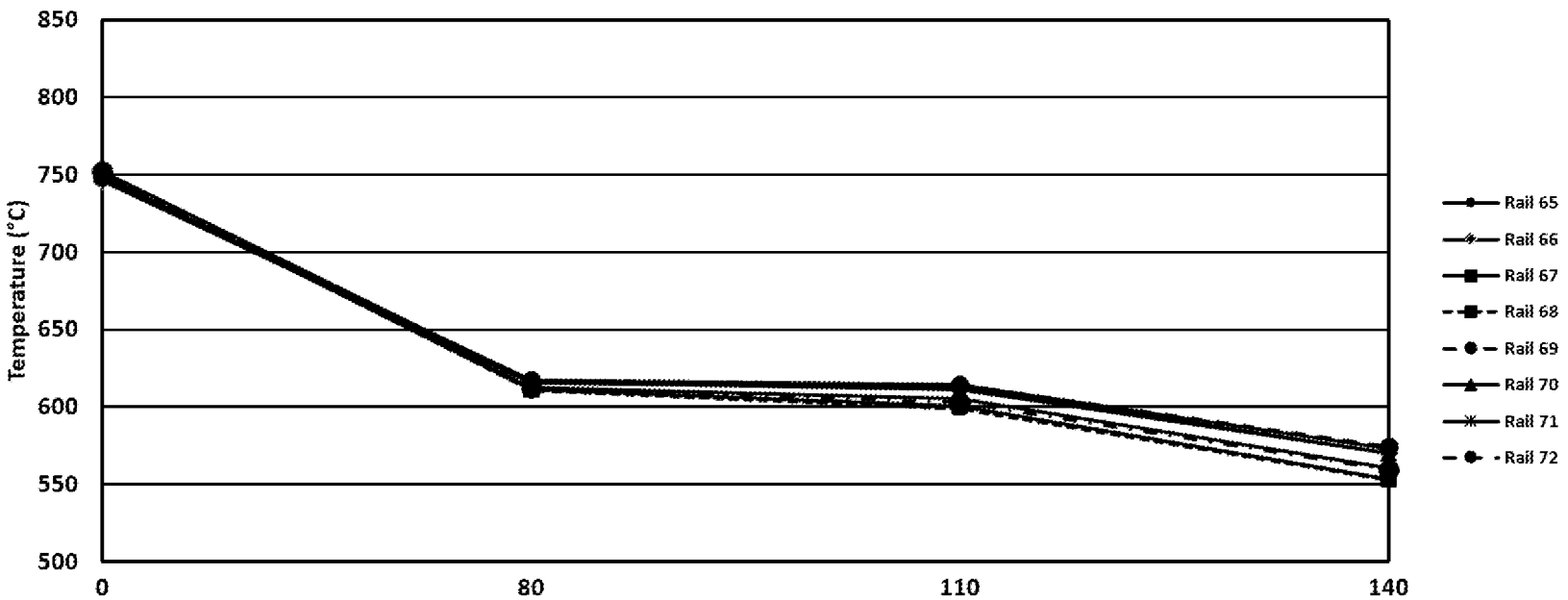
FIG. 3 plots the cooling curves of 8 rails of the present invention.

The water flow rate is controlled in two independent sections of the cooling chamber; each section being 50 meters long. For example, in processing the 115E profile (115 lb/yd), the base spray water flow rates are adjusted for each 50 meter section to achieve the proper cooling rate to attain a fine pearlitic microstructure in the tee rail base. FIG. 3 plots the cooling curves of 8 rails of the present invention as they pass consecutively through the sections of the chamber. Specifically, FIG. 3 plots the rail base temperature in ° C. vs the time since entering the first section of the chamber.

An important part of the invention is controlling the cooling rate in the two independent sections of the cooling chamber. This is accomplished by precise control of water flow in each of the two sections; particularly the total flow to the base nozzle in each section. For the 8 rails of the present invention discussed above in relation to FIG. 3, the water flow rate to the base nozzles in the first 50 meter section was 15-40 $m^3$/hr and 5-30 $m^3$/hr in the 2nd section.

Figure 4:
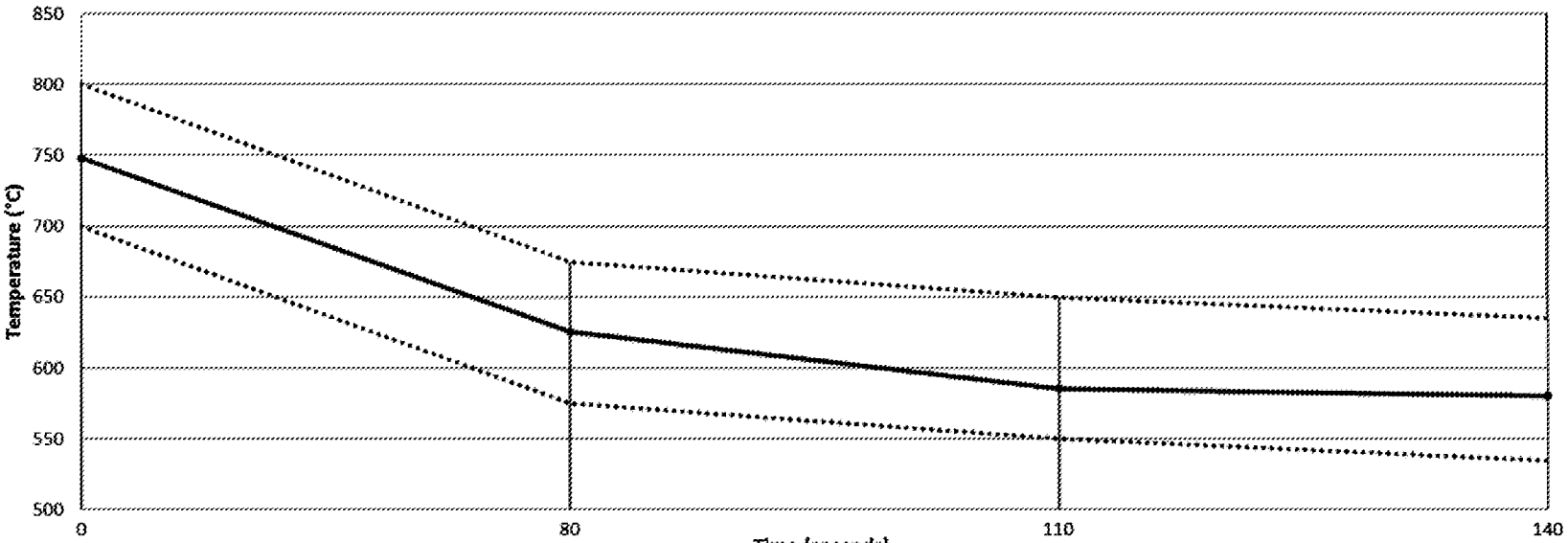
FIG. 4 plots the rail head temperature in ° C. vs the time since entering the cooling chamber for a single rail and shows dotted lines indicating the top and bottom boundaries of the inventive cooling envelope.

After the rail exits the last section, it is cooled by air cooling to ambient temperature. This partitioning of water flow influences the hardness level and the depth of hardness in the rail base. The cooling curve of the first of the 8 rails in FIG. 3 is plotted in FIG. 4 to show the result of water partitioning. Specifically FIG. 4 plots the rail head temperature in ° C. vs the time since entering the first section of the chamber for a single rail. The dotted lines indicate the top and bottom boundaries of the inventive cooling envelope.

The greatest amount of water is applied in the 1st section, which creates a cooling rate fast enough to suppress the formation of proeutectoid cementite and initiate the start of the pearlite transformation below 700° C. (between 600-700° C.). The lower the starting temperature of the pearlite transformation, the finer the pearlite interlamellar spacing and the higher the rail hardness. Once the tee rail base begins to transform to pearlite, heat is given off by the pearlite transformation—called the heat of transformation—and the cooling process slows dramatically unless the proper amount of water is applied. Actually, the surface temperature can become hotter than before: this is known as recalescence. A controlled high level of water flow is required to take away this excess heat and allow the pearlite transformation to continue to take place below 700° C. The water flows in the 2nd section continues to extract heat from the rail surface. This additional cooling is needed to obtain good depth of hardness.

As stated above, the dotted lines in FIG. 5 show the inventive cooling envelope and the three cooling regimes of the present invention. The first cooling regime of the cooling envelope spans from 0-80 seconds into the cooling chamber. In this regime of the cooling envelope the cooling curve is bounded by an upper cooling limit line and a lower cooling limit line (dotted lines in FIG. 4). The upper cooling line spans from time t=0 sec at a temperature of about 800° C. to t=80 sec and a temperature of about 675° C. The lower cooling line spans from time t=0 sec at a temperature of about 700° C. to t=80 sec and a temperature of about 575° C.

The second cooling regime of the cooling envelope spans from 80 to 110 seconds into the cooling chamber. In this regime of the cooling envelope the cooling curve is again bounded by an upper cooling limit line and a lower cooling limit line (dotted lines in FIG. 4). The upper cooling line spans from time t=80 sec at a temperature of about 675° C. to t=110 sec and a temperature of about 650° C. The lower cooling line spans from time t=80 sec at a temperature of about 575° C. to t=110 sec and a temperature of about 550° C.

The third cooling regime of the cooling envelope spans from 110 to 140 seconds into the cooling chamber. In this regime of the cooling envelope the cooling curve is again bounded by an upper cooling limit line and a lower cooling limit line (dotted lines in FIG. 4). The upper cooling line spans from time t=110 sec at a temperature of about 650° C. to t=140 sec and a temperature of about 635° C. The lower cooling line spans from time t=110 sec at a temperature of about 550° C. to t=140 sec and a temperature of about 535° C.

Within the three cooling regimes of the cooling envelope, the cooling rate is in three stages. In stage 1, which spans the first 80 seconds into the cooling chamber, the cooling rate is between about 1.25° C./sec and 2.5° C./sec down to a temperature of between about 525° C. and 675° C. Stage 2 spans from 80 second to 110 seconds in which the cooling rate is between 1° C./sec and 1.5° C./sec down to a temperature of between about 550° C. and 650° C. Stage 3 spans from 110 second to 140 seconds in which the cooling rate is between 0.1° C./sec and 0.5° C./sec down to a temperature of between about 535° C. and 635° C. Thereafter the rails are air cooled to ambient temperature.

Unless stated otherwise, all percentages mentioned herein are by weight.

What is claimed is:

1. A method of making a base-hardened tee rail comprising the steps of:

providing a carbon steel tee rail having a composition including, in weight percent: Carbon: 0.74-0.86; Manganese: 0.75-1.25; Silicon: 0.10-0.60; Chromium: 0.30 Max; Vanadium: 0.01 Max; Nickel: 0.25 Max; Molybdenum: 0.60 Max; Aluminum: 0.010 Max; Sulphur: 0.020 Max; Phosphorus: 0.020 Max; and a remainder being iron and residuals, the steel tee rail provided at a temperature between 70° and 800° C.;

cooling the steel tee rail at a cooling rate that, if plotted on a graph with xy-coordinates with the x-axis representing cooling time in seconds and the y-axis representing temperature in ° C. of the surface of the base of said steel tee rail, is maintained in a region between:

an upper cooling rate boundary plot defined by an upper line connecting xy-coordinates (0 s, 800° C.), (80 s, 675° C.), (110 s, 650° C.) and (140 s, 635° C.); and a lower cooling rate boundary plot defined by a lower line connecting xy-coordinates (0 s, 700° C.), (80 s, 575° C.), (110 s, 550° C.) and (140 s, 535° C.); and wherein the cooling rate from 0 second to 80 seconds plotted on the graph has an average within a range of between about 1.25° C./sec and 2.5° C./sec, the cooling rate from 80 seconds to 110 seconds plotted on the graph has an average within a range of between about 1° C./sec and 1.5° C./sec; and the cooling rate from 110 seconds to 140 seconds plotted on the graph has an average within a range of between about 0.1° C./sec and 0.5° C./sec.

* * * * *